United States Patent [19]

Yu et al.

[11] Patent Number: 5,076,236

[45] Date of Patent: Dec. 31, 1991

[54] FUEL CUTOFF FOR BETTER TRANSIENT CONTROL

[75] Inventors: Robert Yu; Julius P. Perr, both of Columbus, Ind.

[73] Assignee: Cummins Engine Company, Inc., Columbus, Ind.

[21] Appl. No.: 495,121

[22] Filed: Mar. 19, 1990

[51] Int. Cl.[5] ..... F02M 47/02

[52] U.S. Cl. ..... 123/467; 123/446; 123/500; 239/88

[58] Field of Search ..... 123/467, 446, 447, 500, 123/501, 506; 239/88-96, 533.9, 533.1-533.8

[56] References Cited

U.S. PATENT DOCUMENTS

| | | | |
|---|---|---|---|
| 2,285,730 | 6/1942 | Lindeman, Jr. . | |
| 2,565,516 | 8/1951 | Patus | 239/88 |
| 2,922,581 | 1/1960 | Garday . | |
| 3,351,288 | 11/1967 | Perr . | |
| 3,355,108 | 11/1967 | Cummins, Jr. . | |
| 3,409,225 | 11/1968 | Maddalozzo | 239/89 |
| 3,544,008 | 12/1970 | Reiners et al. . | |
| 4,129,253 | 12/1978 | Bader, Jr. et al. . | |
| 4,153,200 | 5/1979 | Fenne | 229/94 |
| 4,471,909 | 9/1984 | Perr . | |
| 4,598,863 | 7/1986 | Kanesaka | 239/94 |
| 4,776,516 | 10/1988 | Klomp | 239/95 |
| 4,813,600 | 3/1989 | Schultz | 239/88 |

*Primary Examiner*—Carl Stuart Miller

*Attorney, Agent, or Firm*—Sixbey, Friedman, Leedom & Ferguson

[57] ABSTRACT

A pressure-responsive spring-biased cutoff valve for an open nozzle unit fuel injector in an internal combustion engine is provided allowing for the selective operation of a given number of cylinders during an engine low load or idling speed condition for improved white smoke control. The fuel injector of the present invention includes an injector body having a central bore with a reciprocating injector plunger positioned therein to form an injection chamber. The injection chamber is supplied with fuel from a supply passage through a metering orifice with the fuel cutoff valve located in the supply passage upstream of and adjacent to the metering orifice and in close proximity to the injection chamber for a substantial reduction in the entry of combustion gases and other unwanted substances into the fuel supply.

14 Claims, 5 Drawing Sheets

FUEL CUTOFF FOR BETTER TRANSIENT CONTROL

BACKGROUND OF THE INVENTION

1. Technical Field

This invention relates to a pressure operated fuel cutoff valve for a unit fuel injector for an internal combustion engine, of the type having an open nozzle and a cam driven reciprocating injector plunger.

2. Description of Related Art

Open nozzle unit fuel injectors are widely utilized because of their ability to achieve desired performance goals while being relatively less complicated and less expensive to manufacture than unit injectors of the closed nozzle type (i.e., unit injectors having pressure operated, normally closed tip valves). Fuel injectors of the open nozzle type often operate on the "pressure/-time" principle developed by the assignee of this application, Cummins Engine Company, Inc. (see U.S. Pat. Nos. 3,351,288, 3,544,008, and 4,471,909). In a pressure/time fuel injector, fuel is metered into the injection chamber of each injector through a restricted metering orifice. The time during which each feed orifice is open and the pressure within the fuel supply line or common rail combine together to control the quantity of fuel metered for injection during each injection cycle. In systems of this type the pressure level of fuel supplied to each injector is caused to be a function of engine load. During low load or idling speed the pressure in the fuel supply line will be low, in contrast to a high load engine condition in which the fuel supply line pressure will be high.

Although this fuel supply system is widely used, problems caused by engine operation at low load or idling speed. In particular, white smoke, unburned hydrocarbons and injector carboning can occur under low load or idling speed of an engine equipped with conventional open nozzle injectors. White smoke is a condition that results on engine start-up or low-load motoring conditions due to improper combustion of fuel because of insufficient compression or temperature levels. In addition, certain precautions must also be undertaken in open nozzle type injectors to minimize the entry of combustion gases and other unwanted substances into the fuel supply system (i.e., a condition known as blowback).

Attempts have been made to provide satisfactory operation of fuel injectors at engine low load or idling speed by providing a pressure control valve in the fuel supply line leading to the injector, such as disclosed in U.S. Pat. No. 2,922,581 to Garday. In particular, the '581 patent discloses a valve with a pressure reduction capability located between the fuel supply pump and the fuel supply delivery line. The pressure reducing effect is attained by the use of variable restrictive passages to produce a uniform reduction in delivery line pressure throughout the full range of engine operation (i.e. from full load to idling speed). Although the purpose of a uniform reduction of delivery line pressure is to obtain more accurate timing and metering of fuel at idling speed, the disclosed arrangement is designed for use on a closed nozzle injector wherein the high pressure pump is separated from the injection nozzle by the delivery line, thereby requiring the delivery line to operate periodically at very high injection pressure. Accordingly, the pressure reducing feature is designed to deal with problems associated with high injection pressure transmitted over relatively long distances to improve the operation of a normally closed injector nozzle having a pressure operated tip valve. Such problems do not exist in open nozzle unit injectors. The '581 patent does not suggest how to minimize the problems associated with low load engine operation, such as white smoke, unburned hydrocarbons and injector carboning in cam operated, open nozzle unit injectors connected with low pressure fuel supply lines.

Many of the fuel injectors currently available attempt to prevent the entry of unwanted substances into the fuel supply. These attempts have generally been characterized by the use of a spring-biased check valve positioned in the fuel supply passage which is responsive to changes in the relative pressure upstream and downstream of the valves. U.S. Pat. Nos. 4,129,253, 2,285,730 and 3,355,108 each show such a check valve located upstream from the injection chamber in the fuel supply passage.

The upstream check valve placement is somewhat effective in reducing unburned hydrocarbons and blowback, however, these undesirable conditions may still exist and must be further minimized in order to achieve the efficient engine operation that is required to satisfy the increasingly higher performance goals of engine manufacturers. Further, use of check valves does not effectively prevent fuel from entering the injection chamber after the engine has been shut off, resulting in diesel engine motoring or run on, and fails to provide satisfactory fuel injector operation at engine low load or idling speed by reduction of white smoke.

SUMMARY OF THE INVENTION

The primary object of the present invention is to overcome the deficiencies of the prior art described above by providing a simplified, cost-efficient fuel supply cutoff device for the fuel injectors of an internal combustion engine that is effective during low load or idling speeds, which does not negatively affect high load engine conditions or emissions.

Another key object of the invention is to provide the capability of selective operation of a given number of cylinders of an internal combustion engine on start-up or low-load motoring conditions for minimizing white smoke, wherein each fuel cutoff valve or a group of valves are provided with springs having differing spring constants resulting in only a selected number of cylinders (for example, 2 cylinders of a 4 cylinder engine or 4 cylinders of an 8 cylinder engine) receiving fuel.

Another object of the invention is to eliminate the need for a multiplicity of costly radial and axial passageways in a unit fuel injector to perform scavenging, in order to remove combustion gases which may have entered the fuel supply.

Another object of the invention is to eliminate, in a unit fuel injector having an open nozzle, the need for check valves located upstream of the feed orifice of the injection chamber by creating an automatic cutoff of fuel just upstream of the metering orifice.

It is still another object of the invention to provide an effective fuel flow cutoff to a fuel injector to prevent fuel from entering the injection chamber after the engine has been shut off resulting in diesel engine motoring or run on.

The invention of the present application achieves these objects and others by the use of a pressure-responsive spring-biased cutoff valve located in a fuel supply passage adjacent to a fuel metering orifice and in close proximity to the injection chamber of an open-nozzle unit fuel injector.

In a preferred embodiment, a fuel cutoff valve is provided in the fuel supply passage leading to the injection chamber of an open-nozzle fuel injector. Such injectors typically include a body including a fuel supply passage, a central bore, and an injector plunger mounted for reciprocating movement in the central bore. An injector chamber is formed between the lower end of the injector plunger and the bottom portion of the central bore which communicates with the fuel supply passage through a metering orifice. The fuel cutoff valve, located in the fuel supply passage adjacent to the metering orifice in close proximity to the injection chamber, includes a flow control plunger biased to block the flow of fuel through the metering orifice into the injection chamber. The fuel cutoff valve is urged to its closed position by a spring and to its open position by the pressure of fuel supplied from a common rail fluidically connected with other injectors associated with the engine. Because the fuel cutoff valve is spring biased, springs of differing characteristics may be used in the respective injectors of a multicylinder engine resulting in the selective operation of a predetermined number of cylinders during an engine low load or idling speed condition. The flow control plunger of the fuel cutoff valve may be tapered to a predetermined angle at its lower end in order to vary the rate of flow of fuel during the transition of the cutoff valve from a position where it initially opens to a fully open position. A drain passage may also be provided to allow for the flow of fuel into the central bore for cooling the fuel injector and to provide a means to return the fuel to the fuel supply.

Still other and more specific objects and features of this invention may be understood from an examination of the following description of the preferred embodiment.

DETAILED DESCRIPTION OF THE PREFERRED EMBODIMENT

Throughout this application, the words "inward", "innermost", "outward" and "outermost" will correspond to the directions, respectively, toward and away from the point at which fuel from an injector is actually injected into the combustion chamber of an engine.

Figure 1:
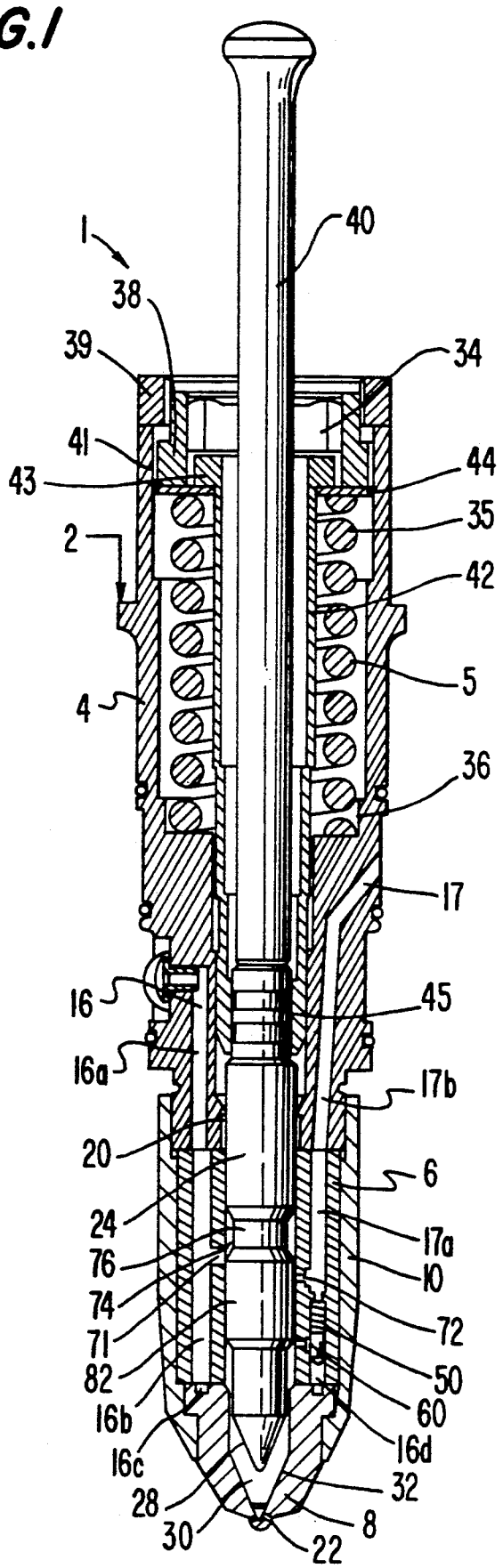
FIG. 1 is a partial cross-sectional view of the preferred embodiment of the fuel injector of the present invention.

FIG. 1 illustrates an open-nozzle, pressure/time unit injector designed in accordance with the subject invention. In particular, FIG. 1 shows an injector 1 including an injector body 2 formed of an upper body 4, a barrel 6 and cup 8, positioned in end-to-end relation, and secured together by a retainer 10. In an internal combustion engine utilizing a plurality of injectors of the type disclosed in FIG. 1, each of the plurality of fuel injectors will have essentially the identical structure and function. As will be explained more fully hereinbelow, the only essential difference in the various injectors serving an engine is that each contains a fuel cutoff valve with a biasing spring whose strength may differ from the strength of the corresponding springs in at least one other injector to cause only a selected number of the plurality of fuel injectors to be operative at a predetermined fuel pressure within the common rail.

Figure 5:
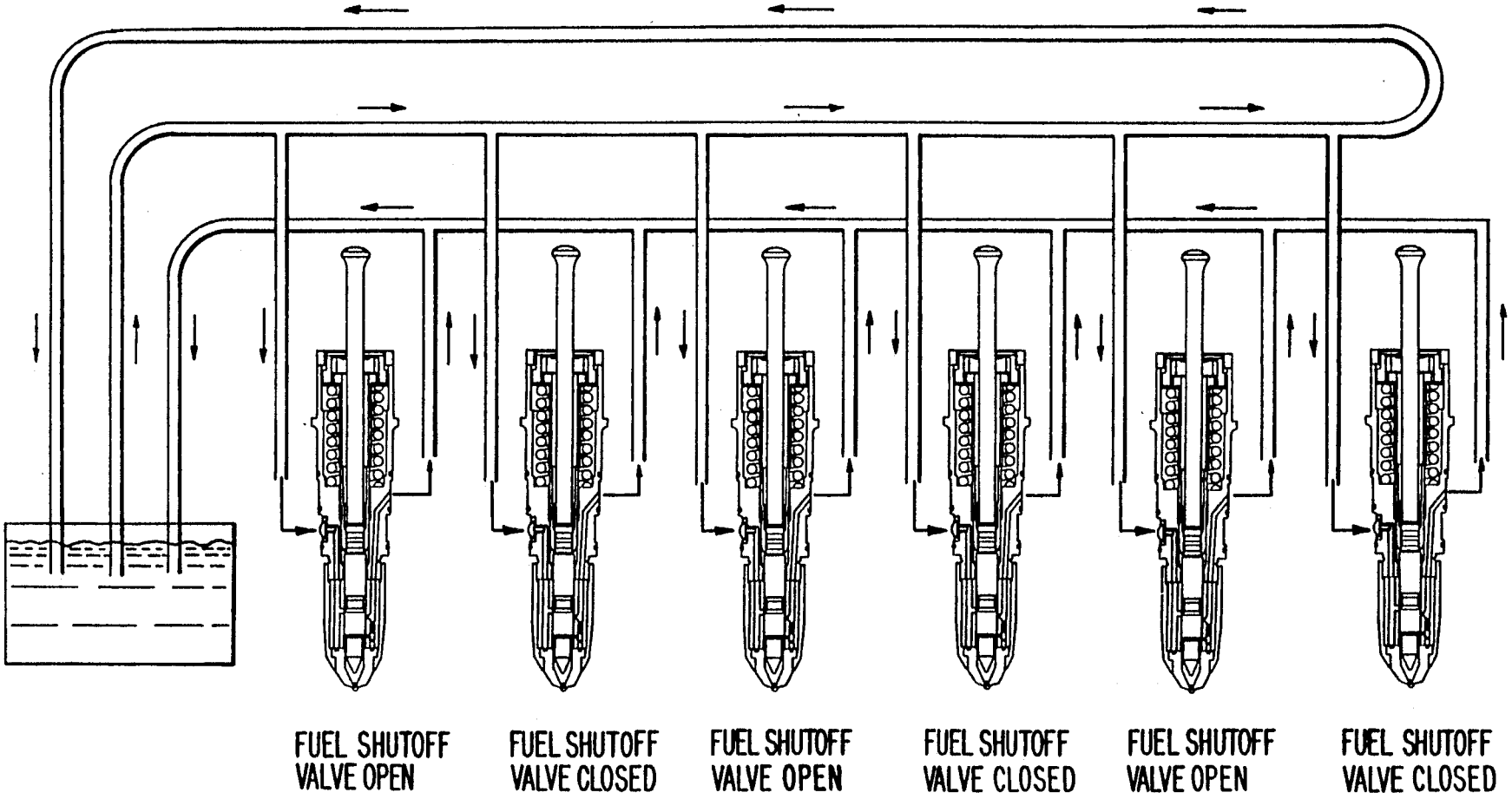
FIG. 5 is a schematic view of six fuel injectors provided with the fuel cutoff valve of the present invention supplied with fuel through a fuel passage (i.e. common rail).

Fuel supply is provided for the injector 1 through a supply channel or common rail (not shown) which supplies fuel from a fuel supply under pressure to the injector 1 and is fluidically connected with other injectors associated with the engine, as schematically depicted in FIG. 5. Fuel is provided to all the injectors from the supply channel under the same pressure within the supply channel. Fuel drainage is provided for the injector 1 through a drain channel (not shown), which receives the fuel discharged from the injector 1 for return to the fuel supply and is also fluidically connected with other injectors associated with the engine, as schematically depicted in FIG. 5.

A supply passage, designated generally as 16, directs the flow of fuel through the injector from the supply channel to an injection chamber 30. The supply passage 16 is comprised of an axial bore **16*a* formed in the upper body 4, an axial bore 16*b* formed in the barrel 6 in alignment with axial bore 16*a*, an annular passage 16*c* formed in the upper surface of cup 8 and an axial bore 16*d* formed in the barrel 6 on the opposite side of the injector 1 relative to the axial bore 16*b*. The annular passage 16*c* provides for fluid communication between the axial bore 16*b* and the axial bore 16*d*. A drain passage, designated generally as 17, directs the flow of unused fuel through the injector to the drain channel. The drain passage 17 is comprised of an axial bore 17*a* formed in the barrel 6 on the opposite side of the injector 1 relative to the axial bore 16*b*, and an axial bore 17*b* formed in the upper body 4 on the opposite side of the injector 1 relative to the axial bore 16*a* in alignment with the axial bore 17*a***.

Injector body 2 is provided with a recess 5, in the upper body 4, and a central bore 20 in upper body 4, barrel 6 and cup 8. At the inner end of the injector body 2 at cup 8, one or more small injection orifices 22 provide a communication path for fuel from the central bore 20 into a combustion chamber (not illustrated) of an internal combustion engine. An injection chamber 30 is formed within central bore 20 between the bottom portion 28 of injector plunger 24 and the inner end 32 of the central bore 20. Fuel is supplied from the injection chamber 30 to the combustion chamber through injection orifices 22 in controlled synchronism with the reciprocating movement of the piston (not illustrated) located in the corresponding engine cylinder.

The injector plunger 24 positioned within the central bore 20 is connected to a link 40 adapted to reciprocate in response to a cam-actuated injector drive train (not illustrated). Essentially, injector plunger 24 reciprocates between an innermost position (FIG. 4), and an outermost position (FIG. 1), in which the injection chamber 30 is formed. Injectors of this type have an inherent cost advantage over more complex closed nozzle injectors which employ a pressure operated tip valve for maintaining the injection orifices in a closed condition except during the injection event. Injector plunger 24 is permanently biased towards its outermost position by a fairly high pressure compression spring 35 located in recess 5 of upper body 4 between a bottom wall 36 of recess 5 and washer 44 fixed to move with plunger 24 by a flange portion 43 of sleeve 42. Sleeve 42 is secured to injector plunger 24 in the area indicated by the numeral 45 and extends upwardly from 45, forming a cylindrical sleeve extending from 45, to rear stop means 34 positioned to engage washer 44, and arrest upward movement thereof. Rear stop means 34 includes a stop 38 threaded into upper body 4 at 41 for selective adjustment thereof. A lock nut 39, threadedly connected with the upper portion of stop 38 is adapted to be tightened against the top of body 4 to lock stop 38 in place after it has been adjusted.

Figure 2:
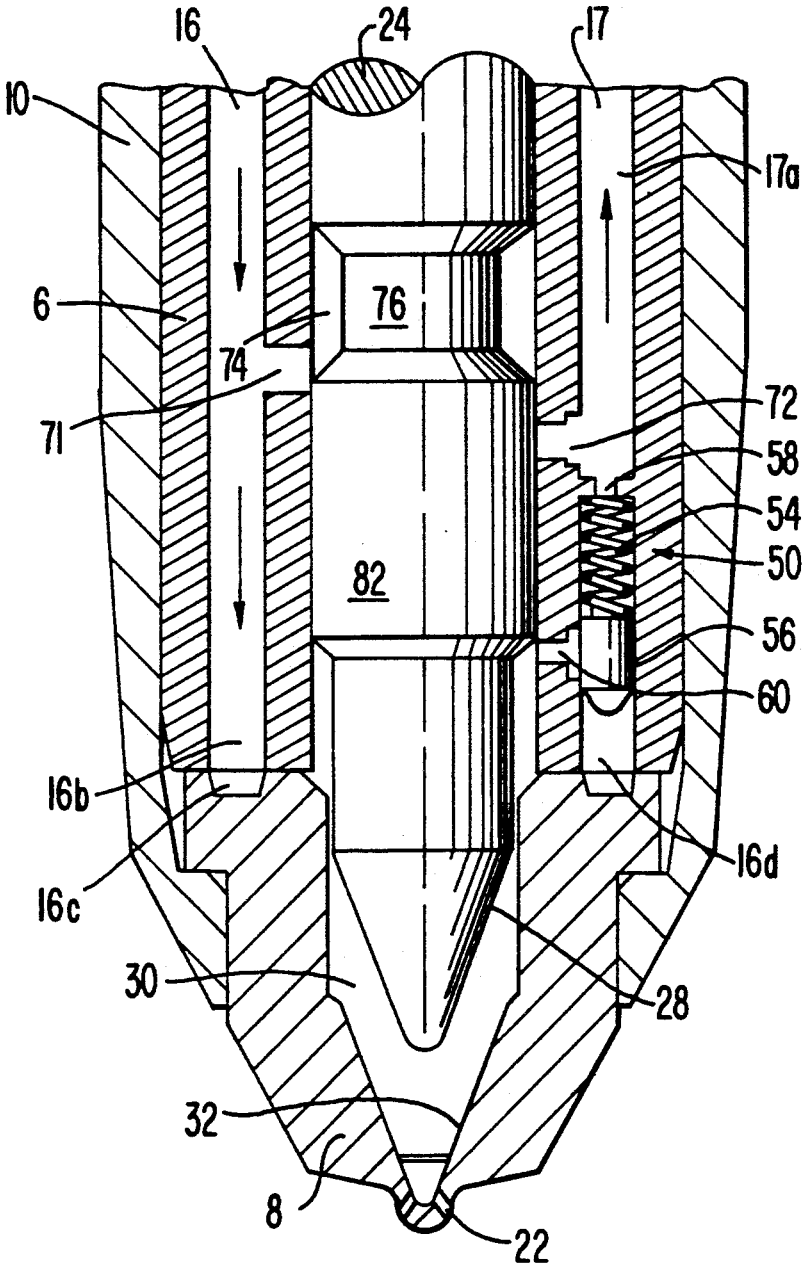
FIG. 2 is an enlarged cross-sectional view of the lower end portion of the fuel injector illustrated in FIG. 1 with the injector plunger in its outermost position and the flow control plunger of the fuel cutoff valve in its innermost position.

Referring to FIG. 2, the quantity of fuel injected during each inward movement of injector plunger 24 is controlled by "pressure/time" principles in which fuel is metered into the injection chamber 30 before each injection stroke. Fuel is supplied to the injection chamber 30 through a metering orifice 60, which has been carefully dimensioned to allow the amount of fuel injected to be varied within a given amount of time by varying the supply channel (common rail) pressure. Thus, the amount of fuel actually metered is a function of the supply pressure and the total metering time during which fuel flows through the metering orifice 60. This general principle is modified in injector 1 by provision of a fuel cutoff means 50, which allows fuel to flow into injection chamber 30 only if a predetermined minimum pressure in the supply channel is reached.

The fuel cutoff means 50 is positioned in portion **16*d* of the fuel supply passage 16 such that it is in the closest proximity possible to the injection chamber 30. This positioning provides several advantages over prior art upstream check valves. The close proximity of the fuel cutoff means 50 with the injection chamber 30 results in a substantial reduction in combustion gases and other undesirable substances which are allowed to enter the fuel supply. Without cutoff means 50 such substances could enter supply passage 16 from the injection chamber 30 during outward movement of the injector plunger 24. Further, the close placement of the fuel cutoff means 50 to injection chamber 30** can eliminate the need for a multiplicity of costly radial and axial passageways to perform scavenging in order to remove combustion gases which have entered the fuel supply. Another advantage of this positioning is the elimination of diesel engine motoring or run on by effectively cutting off fuel flow to the injection chamber after the engine has been shut off.

Fuel cutoff means 50 includes a helical spring 54 and a flow control plunger 56 mounted for reciprocating movement in the portion **16*d* of the fuel supply passage 16. The flow control plunger 56 is maintained at its innermost position to block the passage of fuel from the supply passage 16 to the injection chamber 30 by a continual inward bias applied by helical spring 54. The helical spring 54 is held in place between the outer end of the flow control plunger 56 and a narrow portion 58 of supply passage 16. During normal operation of the injector 1, no fuel should pass into narrow portion 58. However, due to the constant reciprocation of the flow control plunger 56, some degradation of the surfaces where flow control plunger 56 contacts portion 16*d* of the fuel supply passage 16, such as scoring, may occur allowing a very small amount of fuel to pass the plunger 56 and enter the area where helical spring 54 is located. This fuel must have a means to flow out of this area so as not to inhibit the operation of the fuel cutoff valve 50. Therefore, the narrow portion 58 also serves as a drain passage for any fuel that passes by the flow control plunger 56 to the area where helical spring 54 is located. However, the primary function of the narrow portion 58 under normal operating conditions, is to secure helical spring 54**.

The flow control plunger 56 will move in an outward direction as the pressure in the supply passage 16 increases, as a result of an increase in the supply channel pressure, until a predetermined pressure is reached such that the flow control plunger 56 is in a position allowing for the passage of fuel from the supply passage 16 to the injection chamber 30. As the pressure in the supply channel increases, the pressure in the supply passage 16 will also correspondingly increase causing the flow control plunger 56 to move outwardly until reaching its outermost position. A metering orifice 60, which has carefully controlled hydraulic characteristics in order to produce the desired pressure/time metering capability discussed above, provides a pathway for fuel to flow from supply passage 16 to the injection chamber 30.

The flow control plunger 56 is tapered at its lower end to a predetermined angle in order to control the rate of the flow of fuel from supply passage 16 through metering orifice 60 during outward movement of the flow control plunger 56 from a position where it starts to open to the fully open position. The angle of taper can be changed to select a different rate of flow of fuel from initial opening of the fuel cutoff valve 50 to the fully open position. The angle of taper also determines the rate of increase and range of pressure from the initial opening pressure, determined by the spring constant of helical spring 54, to the pressure at which the fuel cutoff valve 50 will be fully open (i.e., initial opening at 10 p.s.i., fully open at 18.7 p.s.i.). The tapered lower end of plunger 56 results in a smooth transition from a low-load or idling speed condition, when the fuel cutoff valve 50 is closed, to a high-load fueling condition, when the fuel cutoff valve 50 is fully open. Both the angle of taper of the lower end of flow control plunger 56 and the spring force of helical spring 54 are carefully determined in order to operate efficiently and effectively in accordance with the pressure/time principle utilized in the injector of the subject invention.

As discussed above, white smoke is a condition that results on engine start-up or low-load motoring conditions due to improper combustion of fuel because of insufficient compression or temperature levels. The fuel cutoff means 50 provides for a substantial reduction of white smoke, as well as a reduction in fuel consumption, by blocking the flow of fuel to the injection chamber 30 on engine start-up or low-load motoring conditions. This condition precludes fuel flow into the injection chamber and, therefore, no fuel can be injected into the combustion chamber.

This advantageous design allows for the selective operation of a given number of cylinders on engine start-up or low-load motoring conditions by providing at least one fuel cutoff valve 50 in at least one fuel injector in an internal combustion engine with a helical spring 54 of a different strength than that of the other fuel cutoff valves in the other fuel injectors. For example, in a four cylinder engine, only two of the cylinders could be operational, i.e., the respective fuel cutoff valves 50 will be open to supply fuel to the injection chamber of its injector, until a predetermined supply pressure is reached, after which all four cylinders are then operational (i.e., all of the fuel cutoff valves 50 will be open to supply fuel to the injection chamber of their injectors). Selective operation of a predetermined number of fuel injectors may also be performed by supplying only a given number of fuel injectors with a fuel cutoff valve 50 (i.e., 2 injectors in a 4 cylinder engine).

Drain passage 17 is provided to direct fuel out of the injector and into the drain channel (not shown) to allow the flow of unused fuel back to the fuel supply and to provide for cooling of the injector body 2 and plunger 24 which can reach high temperatures because of the injector's proximity to the corresponding combustion chamber of the engine. The cooling function is performed by providing drain openings 71 and 72, creating a path for fuel to flow into and out of the central bore 20, where it flows around injector plunger 24 in a chamber 74, formed between an annular cooling groove 76 of the injector plunger 24 and the adjacent wall of barrel 6.

Figure 3:
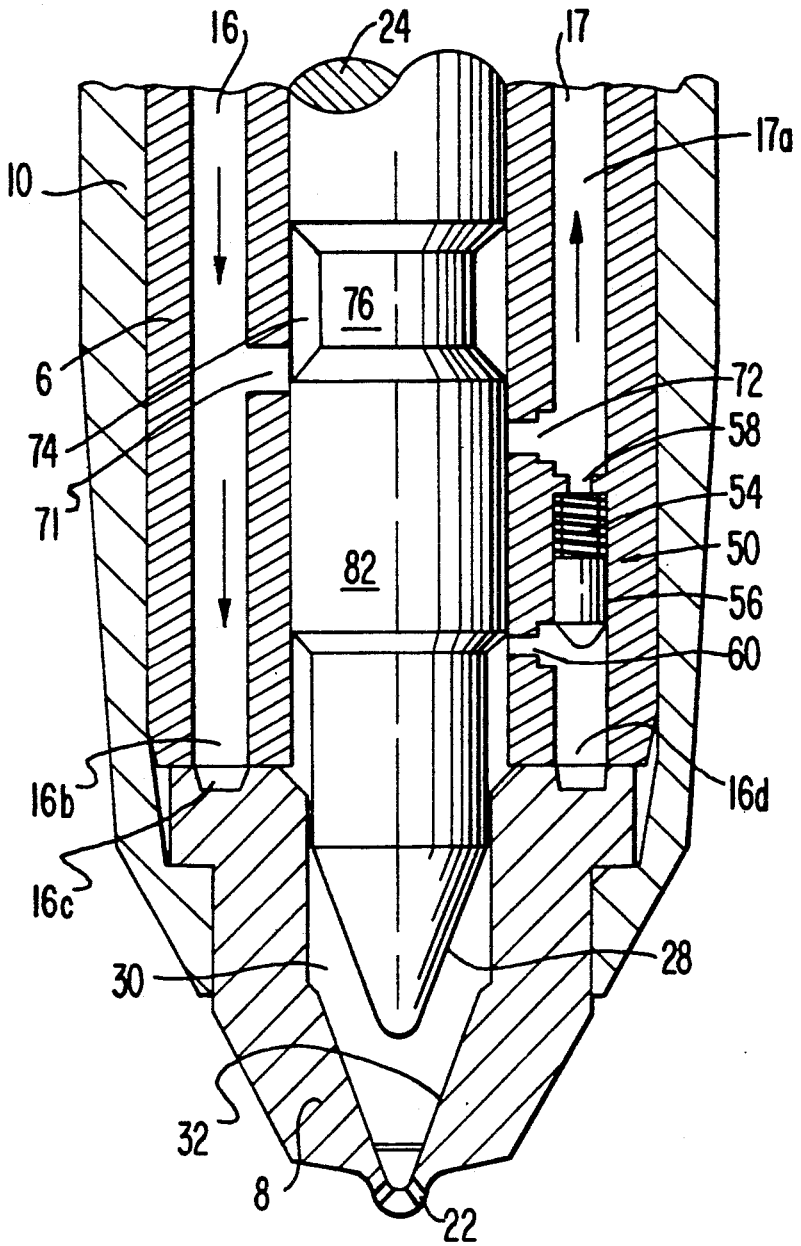
FIG. 3 is a view corresponding to FIG. 1 but in which the flow control plunger of the fuel cutoff valve has been moved to its outermost position.
Figure 4:
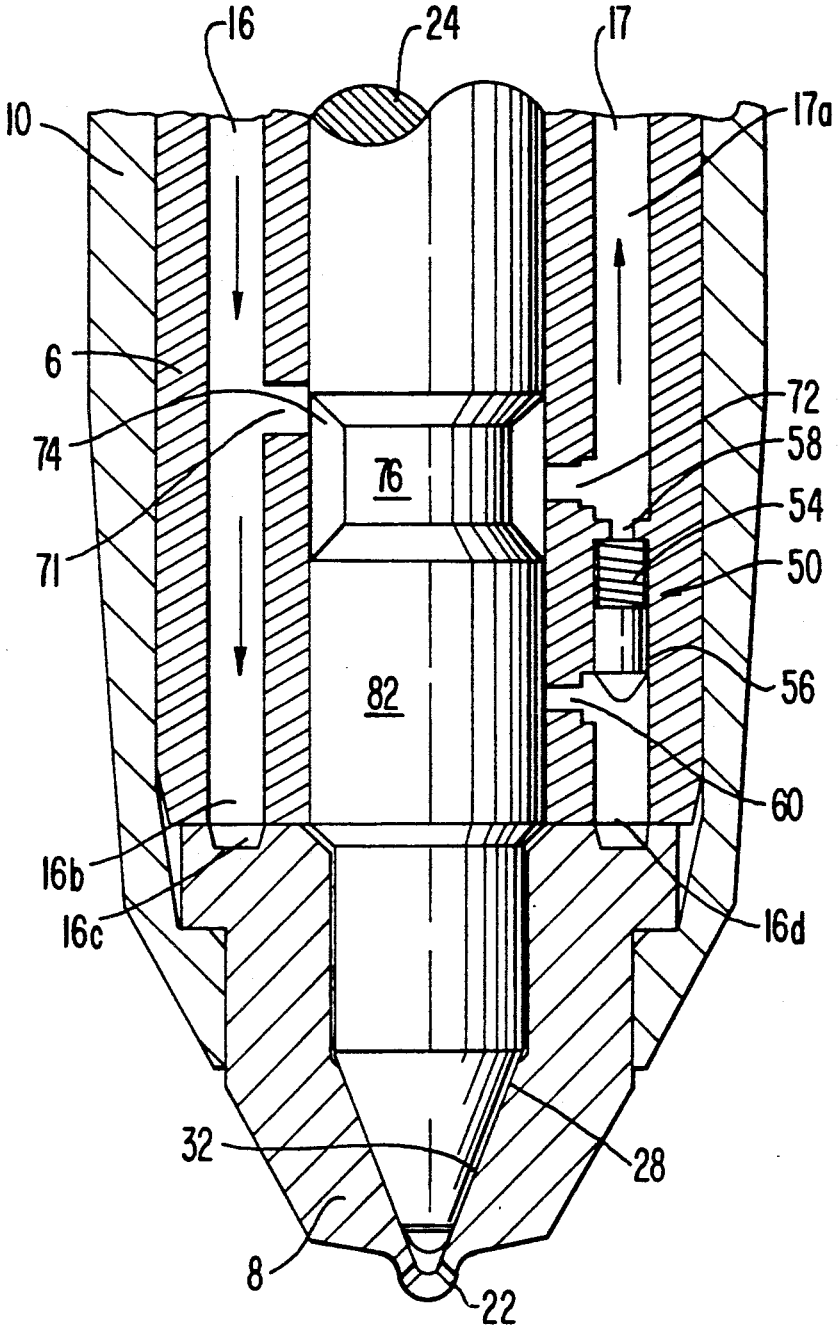
FIG. 4 is a view corresponding to FIG. 2 but in which the injector plunger has been moved to its innermost position.

The operation of the embodiment illustrated in FIG. 1 can now best be understood by also referring to FIGS. 2–4, which disclose the same injector in which the injector plunger 24 is moved from the outermost to the innermost position and fuel cutoff valve 50 is moved from the innermost to the outermost position. At the start of the injection period, injector plunger 24 is in its outermost position. As illustrated by the arrows, fuel flows through the supply passage 16 and through drain opening 71, filling annular chamber 74. The fuel cannot flow out of chamber 74 because sealing portion 82 of injector plunger 24 is blocking opening 72.

The fuel continues to flow beyond drain opening 71, through portion **16*b* of supply passage 16, entering the annular passage 16*c*, which provides fluid communication between portions 16*b* and 16*d* of fuel supply passage 16. From annular passage 16*c*, the fuel continues to flow through portion 16*d* of supply passage 16 until reaching fuel cutoff valve 50. As indicated previously, fuel cutoff valve 50 is pressure-responsive, and therefore, will only start to move outwardly towards its open position when a predetermined pressure in the supply channel is reached. As shown in FIG. 2, fuel flow from supply passage 16 to the injection chamber 30 is blocked by the flow control plunger 56, as a result of insufficient pressure in the supply channel. The flow control plunger 56 will remain in this position, cutting off the fuel flow to the injection chamber 30, as long as the pressure in the supply channel is not high enough to cause the fuel cutoff valve 50** to open.

As represented in FIG. 3, when the pressure of the fuel in the supply channel increases, causing a corresponding increase in pressure of the fuel in the supply passage 16, and a pressure level high enough to cause the fuel cutoff valve to open is reached, fuel will flow through metering orifice 60 at a predetermined rate and enter the injection chamber 30. This rate of flow is governed by the angle of taper of the lower end of the flow control plunger 56.

As the pressure in the supply channel increases, the flow control plunger 56 will continue to move outwardly until finally reaching its outermost position, as illustrated in FIG. 3. When the fuel cutoff valve 50 is in an open position, fuel flows through the metering orifice 60 into the injection chamber 30 for a given period of time, based on the pressure/time principle noted above.

As injector plunger 24 moves inwardly, groove 76 moves down toward the opening 72 while, at the same time, a sealing segment 82 of plunger 24 (located between lower section 28 and groove 76) moves down toward the passage 60, so that segment 82 seals passage 60 and then groove 76 uncovers opening 72. Thus, after metering of fuel into the injection chamber 30 has ended, the fuel flowing into portion **16*b* of supply passage 16 is able to flow into groove 76 to the drain passage 17. The fuel from drain passage 17 flows into the drain channel (not shown) and is returned back to the fuel supply. Simultaneously as injector plunger 24 moves inwardly, the fuel trapped in the injection chamber 30 will be forced through injection orifices 22 into the combustion chamber (not illustrated). When the injection period is complete, the injection plunger 24 is in its innermost position, as shown in FIG. 4**.

To better illustrate the operation of the subject invention, reference is made to FIG. 5 which shows a plurality of fuel injectors (i.e. six) each being provided with a fuel cutoff valve 50. As previously described, the force of helical spring 54 in fuel cutoff valve 50 can be varied from one injector to another of the same engine to cause the cylinders of the engine to become operative (i.e., the fuel injectors of the cylinder are supplied with fuel) at differing pressure levels of the fuel in the supply channel for controllably operating an engine on differing numbers of cylinders under differing conditions of use. If the engine is operating at a low load or idling speed condition, the pressure in the supply channel (i.e. common rail) and supply passage 16 may not reach the necessary predetermined level to open the fuel cutoff valve 50 of all of the fuel injectors. As a consequence, fuel will not flow into the injection chamber of those fuel injectors in which the cutoff valve 50 remains closed. Therefore, no combustion will occur in the corresponding engine cylinders served by those fuel injectors.

As described above, the determination of which fuel injectors will not be supplied with fuel is a function of both the pressure in supply channel 12 and the spring constant of helical spring 54 of the fuel cutoff valve 50. Helical springs 54 with high spring constants can be placed in the fuel cutoff valve 50 in a selected number of fuel injectors, with springs of lower spring constants in others. As a result, the engine will operate on only those selected number of fuel injectors, and corresponding cylinders, associated with valves 50 having low spring constants prior to a predetermined pressure level being reached in the fuel supply channel sufficient to open those valves 50 controlled by high spring constant helical springs 54.

For example, as shown in FIG. 5, three of the fuel injectors have been provided with fuel cutoff valves having helical springs of one spring constant (a high one) and the remaining three fuel injectors have been provided with fuel cutoff valves having helical springs of a second spring constant (a lower one). The pressure in the supply channel has not reached a high enough level to cause the fuel cutoff valves of the first group of three fuel injectors to open. However, the supply channel pressure is sufficient to cause the cutoff valves of the second group of three injectors to open. As a result, the combustion will only occur in the cylinders corresponding to the second group of three injectors. Engine operation on only three cylinders will result until the pressure level in the supply channel raises to a high enough level to cause the fuel cutoff valves of the first group of three injectors to open. This will typically occur when the engine is no longer in a low load or idling speed condition.

This method of selective operation of fuel injectors has the positive effects of minimizing white smoke and decreasing fuel consumption without inhibiting normal or high load engine operation. However, it should be recognized that it is not necessary to the invention that selective operation be produced as an engine could be operated, as is conventional, on all cylinders at all times by using springs of the same value in all injectors of the engine.

The invention of the subject application should not be viewed as being limited to the embodiment shown. Numerous fuel injector designs are possible having a different number and configuration of axial and radial fuel passages, as well as, different injector body shapes, sizes and parts. Also, while a helical spring 54 has been found advantageous other types of springs may be used instead. These design changes may be made without departing from the spirit and scope of the invention as the same will now be understood by those skilled in the art as encompassing the full scope of the appended claims.

INDUSTRIAL APPLICABILITY

The open-nozzle fuel injector with a pressure-responsive spring-biased cutoff valve of the present invention will find application in a large variety of internal combustion engines in almost every field of use. The valve of the present invention would be useful in any internal combustion engine where a simple, low cost white smoke control device is desired.

We claim:

1. A fuel injector for use in an internal combustion engine for periodically injecting a metered quantity of fuel supplied under varying pressure from a fuel supply into a combustion chamber of the engine, said fuel injector comprising:

(a) a body containing a central bore, a fuel supply passage adapted to direct fuel from the fuel supply into the central bore, and at least one injection orifice through which fuel in said central bore may be injected into the combustion chamber, (b) an injector plunger mounted for reciprocating movement within the central bore between a innermost position and an outermost position to form an injection chamber within said central bore below the innermost end of said plunger when said plunger is displaced from its innermost position, said injection chamber being in constant communication with said injection orifice and in communication with said fuel supply passage when said injector plunger is displaced at least a predetermined distance from its innermost position; and (c) fuel cutoff means associated with said supply passage and in close proximity to said injection chamber for closing off the communication between said supply passage and said injection chamber wherever the fuel pressure in said supply passage upstream of said fuel cutoff means falls below a predetermined limit, wherein said predetermined limit is independent of the pressure within said injection chamber.

2. A fuel injector as defined in claim 1, in which said fuel cutoff means includes a flow control plunger mounted for pressure-responsive reciprocating movement between a closed position in which said supply passage is closed by the flow control plunger and an open position in which fuel is permitted to flow from the fuel supply passage into the injection chamber.

3. A fuel injector as defined in claim 2, wherein said fuel cutoff means includes flow rate control means for varying the rate of flow of fuel from said fuel supply passage into said injection chamber as the flow control plunger moves from said closed position to said open position, said flow rate control means including a tapered portion on one end of said flow control plunger.

4. A fuel injector as defined in claim 2, in which said flow control plunger is biased to its closed position by a spring, said spring having a predetermined spring constant which determines the fuel pressure at which the flow control plunger will initially be displaced toward said open position.

5. A fuel injector as defined in claim 1, wherein said fuel supply passage includes a restricted metering orifice shaped to cause the quantity of fuel allowed to flow into said injection chamber to be dependent on the pressure of fuel in said supply passage and the time over which fuel is allowed to flow during each cycle of injection operation.

6. A fuel injector as defined in claim 5, in which the diameter of said metering orifice is selected to cause the quantity of fuel which flows into the injection chamber to be determined by the interval of time which the metering orifice is open and the pressure of the fuel in said supply passage.

7. A fuel injector as defined in claim 1, further including a fuel drain passage adapted to direct fuel from said fuel supply passage and said central bore to said fuel supply.

8. A fuel injection system for periodically and selectively injecting metered quantities of fuel into the cylinders of a multicylinder internal combustion engine, comprising:

(a) a plurality of fuel injectors equal in number to the number of cylinders of the internal combustion engine, said fuel injectors being operatively associated with the cylinder, respectively, each said injector including:

(i) a body containing a central bore, a fuel passage adapted to direct fuel from the fuel supply into the central bore and at least one injection orifice through which fuel in said central bore may be injected into the combustion chamber, (ii) an injector plunger mounted for reciprocating movement within the central bore between an innermost position and an outermost position to form an injection chamber within said central bore below the innermost end of said plunger when said plunger is displaced from its innermost position, said injection chamber being in constant communication with said injection orifice and in communication with said fuel supply passage when said injector plunger is displaced at least a predetermined distance from its innermost position, and (iii) a fuel cutoff plunger associated with said fuel supply passage in close proximity to said injection chamber and movable from a closed position in which the flow of fuel from said fuel supply passage into said injection chamber is blocked to an open position in which fuel is allowed to flow from said supply passage into said injection chamber, said cutoff plunger being biased toward said open position by the pressure of fuel in said supply passage upstream of said cutoff plunger; and (b) biasing means for independently biasing each of said cutoff plungers toward its closed position with a sufficient force to maintain said cutoff plunger in said closed position until the fuel pressure in said supply passage upstream of said cutoff plunger is above a predetermined minimum level wherein said predetermined minimum level is independent of the pressure within said injection chamber.

9. A fuel injection system as defined in claim 8, wherein said fuel cutoff plunger includes flow rate control means for varying the rate of flow of fuel from said fuel supply passage into said injection chamber as the flow control plunger moves from said closed position to said open position, said flow rate control means including a tapered portion on one end of said flow control plunger.

10. A fuel injection system as defined in claim 8, wherein said fuel supply passage includes a restricted metering orifice shaped to cause the quantity of fuel allowed to flow into said injection chamber to be dependent on the pressure of fuel in said supply passage and the time over which fuel is allowed to flow during each cycle of injection operation.

11. A fuel injector as defined in claim 10, in which the diameter of said metering orifice is selected to cause the quantity of fuel which flows into the injection chamber to be determined by the interval of time which the metering orifice is open and the pressure of the fuel in said supply passage.

12. A fuel injector as defined in claim 8, further including a fuel drain passage adapted to direct fuel from said fuel supply passage and said central bore to said fuel supply.

13. A fuel injector as defined in claim 1, in which said fuel cutoff means is positioned in said supply passage and at least a portion of said fuel cutoff means intersects the radial plane defined by the outer axial limit of said injection chamber.

14. A fuel injector as defined in claim 8, in which said fuel cutoff plunger is positioned in said supply passage and at least a portion of said fuel cutoff plunger intersects the radial plane defined by the outer axial limit of said injection chamber.

* * * * *